US006784835B2

(12) United States Patent
Kohno et al.

(10) Patent No.: US 6,784,835 B2
(45) Date of Patent: Aug. 31, 2004

(54) ARRAY ANTENNA

(75) Inventors: Ryuji Kohno, Tokyo (JP); Abreu Giuseppe, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/307,725

(22) Filed: Dec. 2, 2002

(65) Prior Publication Data

US 2003/0179136 A1 Sep. 25, 2003

(30) Foreign Application Priority Data

Dec. 3, 2001 (JP) ..... 2001-369380

(51) Int. Cl.[7] ..... H01Q 3/00; H01Q 3/22; H01Q 3/24

(52) U.S. Cl. ..... 342/360; 342/368; 342/372

(58) Field of Search ..... 342/360, 368, 342/372

(56) References Cited

U.S. PATENT DOCUMENTS 4,173,759 A * 11/1979 Bakhru ..... 342/382
5,471,220 A * 11/1995 Hammers et al. ..... 342/372
6,121,917 A * 9/2000 Yamada ..... 342/128

* cited by examiner

*Primary Examiner*—Stephen C. Buczinski
(74) *Attorney, Agent, or Firm*—Frommer Lawrence & Haug LLP; William S. Frommer; Dennis M. Smid

(57) ABSTRACT

An array antenna comprising a plurality of antenna elements, multipliers for multiplying coefficients with transmission or reception signal and a calculator for calculating the coefficients for each multiplier. The calculator generates the coefficients in a proposed method such that the beam-pattern of the array antenna has a flat top mainlobe with an adjustable beamwidth and a predetermined sidelobe ratio.

3 Claims, 10 Drawing Sheets

ARRAY ANTENNA

DETAILED DESCRIPTION OF THE INVENTION

The present invention relates to an array antenna, particularly relates to an array antenna capable of forming a beampattern with an adjustable beamwidth and low sidelobes.

BACKGROUND ART

Conventional Dolph-Tchebysheff arrays were proposed by Dolph in 1946 [1] and are designed by mapping the Tchebysheff polynomial into the array's space factor. Dolph has proven that for a desired sidelobe level, the Tchebysheff polynomial of order L−1 can be mapped into the spatial factor of a uniform linear array (ULA)—an array of a plurality of antenna elements having a certain inter-element space—of L elements resulting in a pattern with the sidelobe level as desired and a mainlobe with the minimum possible width. Originally, the design of Dolph-Tchebysheff current distributions was restricted to linear arrays and was applicable to broadside steering only. In fact, little has changed since the classical Dolph-Tchebysheff method came about. For instance, some advances on how to compute the Dolph-Tchebysheff current distribution [1] itself were made by Stegen [3], Davidson [4] and Jazi [5]. More recently, Jazi proposed [6] to use a Tchebysheff polynomial elevated to the n-th so to elevate the order of nulls in the pattern and reduce the number of sidelobes, yielding patterns with the same prescribed sidelobe level, but with a higher directivity, at the expense of slightly broadening the mainlobe.

Finally, the application of Tchebysheff current distributions to a uniform circular array (UCA) was verified [2], making use of a technique that allows the transformation of a UCA into a virtual ULA, long ago presented in [7]. Consequently, a 360° spatial span can be scanned with a nearly perfectly invariant beampattern by electronically rotating of a Dolph-Tchebysheff beampattern.

Problem to be Solved by the Invention

The drawback of this approach is that the mainlobe's beamwidth of the UCA is larger than that of a ULA with the same number of elements and the same inter-element spacing, because the later has a larger aperture than the former. In fact, it is easy to verify from equations (1) and (2) below, which give respectively the broadside aperture of a ULA and the maximum aperture of a UCA with L elements and inter-element spacing Δe, that for large arrays the ratio, $A_{ULA}/A_{ULC}=\pi$, independently of Δe.

Equation 1

$$A_{ULA}(L,\Delta e)=(L-1)\Delta e \tag{1}$$

Equation 2

$$A_{UCA}(L,\Delta e)=\frac{\Delta e}{2\sin\left(\frac{\pi}{L}\right)}\left(1-\cos\left(\frac{2\pi}{L}\left\lfloor\frac{L}{2}\right\rfloor\right)\right) \tag{2}$$

Therefore, in applications such as direction of arrival (DOA) estimation in an intelligent transportation system (ITS) where it is desired to perform a spatial scanning only over a limited angular span with a fixed beamwidth, rotation-invariant, equiripple low sidelobe pattern, a ULA would provides the narrowest beam for the same desired SideLobe Ratio (SLR) at broadside. On the other hand, in this case, the mainlobe's width gets larger as the array is steered to angles closer to end-fire, so that the rotation invariance is lost. Thus, the designer faces the dilemma of either sacrificing too much on the beamwidth by choosing a Dolph-Tchebysheff UCA beampattern or too much on the rotation invariance, by choosing a Dolph-Tchebysheff ULA beampattern.

Yet from another point of view, even when the spatial scanning is desired over the whole 360° spatial span, unlike radar applications where the beamwidth of the rotation-invariant array pattern must be as narrow as possible, in communications, there are many applications such as spatial equalization and beam space-time coding, where it is desirable that the beamwidth of the rotation-invariant pattern be adjustable. Therefore, although the contribution in [2] really adds to the flexibility of the design of low sidelobe arrays in terms of its rotation invariance, due to the use of the classical Dolph-Tchebysheff method, it does not deliver the necessary complete flexibility desired.

In order to strengthen the points made above, a brief review of the existing techniques mentioned will be made. We start with the Tchebysheff polynomial used in the classic Dolph design that can be written as below [8].

Equation 3

$$T(N,x)=\begin{cases}\cos(N\arccos(x)) & \text{if } |x|\le 1\\ \cosh(N\arccos h(x)) & \text{if } |x|\ge 1\end{cases} \tag{3}$$

Given a prescribed sidelobe ratio in dB ($SLR_{dB}$), the voltage sidelobe ratio ($SLR_V$) can be computed according to the following equation:

Equation 4

$$SLRv=10^{\frac{-SLR_{\mathrm{dB}}}{20}}. \tag{4}$$

In order to design a sidelobe pattern with the given SLRv, first the value of x that makes the |T(N,x)| equal to SLRv is computed. Such a value is given by the following equation:

Equation 5

$$x_0=\cos\left(\frac{\arccos h(SLRv)}{N}\right) \tag{5}$$

Note that N=L−1, where L is the element number. Since the Tchebysheff polynomial has only real coefficients and all of its roots lie in the interval x E[−1, 1], |T(N,x)| is monotonically increasing for |x|>1. Therefore:

Equation 6

$$|T(N,y)|>|T(N,z)|>1\,\forall y>z>1 \tag{6}$$

Within the interval x E[−1, 1], however, the polynomial has its amplitude limited to 1, as can be seen in FIG. 1. Dolph visualized that, if a ULA with L elements and inter-element spacing Δe is used, the excitation of the n-th antenna element is calculated by:

Equation 7

$$A_n=\sum_{m=1}^{L}T\left(L-1,x_0\cos\left(\frac{\pi m}{L}\right)\right)e^{-j(2n-L-1)\frac{\pi m}{L}} \tag{7}$$

where n=1, 2, . . . , L. If the phases of the signals at all elements are driven so to steer the mainlobe's peak towards an angle $\theta_S$, the resulting beampattern will exhibit a space factor exactly given by the equation below (FIG. 2).

Equation 8

$$|T(L-1, x_0 \cos(\pi\Delta e(\cos(\theta)-\cos(\theta_s))))| \tag{8}$$

While the amplitude limitation of the Tchebysheff polynomial is responsible for the equiripple sidelobes, the monotonic behavior for $|x|>1$ is responsible for its mainlobe's width inflexibility.

The beamwidth of a pattern steered to $\theta_S$, can be computed once the criterion that defines the limits of the mainlobe is chosen. In the case of equiripple low sidelobe patterns, a reasonable choice is the point where the mainlobe crosses the sidelobe upper bound, i.e., the sidelobe level beamwidth ($\Delta\theta_{SL}$) is defined in terms of the distances between the steering angle ($\theta_S$) and the angles to the right ($\theta_R$) and to the left ($\theta_L$) of the mainlobe's peak where the gain equals the sidelobe level. If a ULA is used, steering towards any direction rather than broadside causes the mainlobe to enlarge, especially at angles close to the endfire. Therefore there is a limiting angle after which the beamwidth will enlarge enough to have part of it falling outside the visible region. Making use of the symmetry of the array, this limit can be defined in terms of a minimum steering angle, for which $\theta_L$ vanishes. Thus:

Equation 9

$$\theta'_{s_{\min}} = \arccos\left(1 - \frac{1}{\pi\Delta e}\arccos\left(\frac{1}{x_{peak}}\right)\right). \tag{9}$$

Equation 10

$$\theta'_s = arcsin(\sin(\theta_s)) \tag{10}$$

values of $x_0$ given in equation (5). Then, if $\theta'_S > \theta'_{Smin}$, $\theta_R$ and $\theta_L$ can be respectively calculated by:

Equation 11

$$\begin{aligned}
&\cosh\left((L-1)\left(\beta - e^{\alpha\left|x_{peak}\cos(\pi\Delta e(\cos(\theta)-\cos(\theta_s)))\right|}\right)\right. \\
&\qquad \left.\arccos\ h(x_{peak}\cos(\pi\Delta e(\cos(\theta)-\cos(\theta_s))))\right) = 1 \\
&\Rightarrow (L-1)\left(\beta - e^{\alpha\left|x_{peak}\cos(\pi\Delta e(\cos(\theta)-\cos(\theta_s)))\right|}\right) \\
&\qquad \arccos\ h\left(x_{peak}\cos(\pi\Delta e(\cos(\theta)-\cos(\theta_s)))\right) = 0 \\
&\Rightarrow x_{peak}\cos(\pi\Delta e(\cos(\theta)-\cos(\theta_s))) = 1 \\
&\Rightarrow \cos(\theta) = \frac{1}{\pi\Delta e}\operatorname{acos}\left(\frac{1}{x_{peak}}\right) + \cos(\theta_s)
\end{aligned} \tag{11}$$

Using this result, it is obvious that:

Equation 12

$$\theta_L = \arccos\left(\frac{1}{\pi\Delta e}\arccos\left(\frac{1}{x_{peak}}\right) + \cos(\theta_s)\right) \quad \text{if } \arcsin(\sin(\theta_s)) < \theta_{s_{\min}} \tag{12}$$

Equation 13

$$\theta_R = \pi - \arccos\left(\frac{1}{\pi\Delta e}\arccos\left(\frac{1}{x_{peak}}\right) - \cos(\theta_s)\right) \quad \text{if } \arcsin(\sin(\theta_s)) < \theta_{s_{\min}} \tag{13}$$

Outside the limits, it is easy to see that $\theta_R$ and $\theta_L$ can be respectively calculated by the following equation:

Equation 14

$$\begin{aligned}
&\cosh\left((L-1)(\beta - e^{\alpha\left|x_{peak}\cos(\pi\Delta e(\cos(\theta)-\cos(\theta_s)))\right|})\arccos\ h(x_{peak}\cos(\pi\Delta e(\cos(\theta)-\cos(\theta_s))))\right) = 1 \\
&\Rightarrow (L-1)(\beta - e^{\alpha\left|x_{peak}\cos(\pi\Delta e(\cos(\theta)-\cos(\theta_s)))\right|})\arccos\ h\left(x_{peak}\cos(\pi\Delta e(\cos(\theta)-\cos(\theta_s)))\right) = (L-1)\pi \\
&\Rightarrow x_{peak}\cos(\pi\Delta e(\cos(\theta)-\cos(\theta_s))) = \pi \\
&\Rightarrow \cos(\theta) = \frac{\pi}{\pi\Delta e}\operatorname{acos}\left(\frac{-1}{x_{peak}}\right) + \cos(\theta_s)
\end{aligned} \tag{14}$$

Equation 15

$$\theta_L = \pi - \arccos\left(\frac{1}{\pi\Delta e}\arccos\left(\frac{-1}{x_{peak}}\right) - \cos(\theta_s)\right) \text{ if } \arcsin(\sin(\theta_s)) < \theta_{s_{\min}} \tag{15}$$

Equation 16

$$\theta_R = \arccos\left(\frac{1}{\pi\Delta e}\arccos\left(\frac{-1}{x_{peak}}\right) + \cos(\theta_s)\right) \text{ if } \arcsin(\sin(\theta_s)) < \theta_{s_{\min}} \tag{16}$$

With the above equations in hand, $\Delta\theta_{SL}$ can finally be computed by:

Equation 17

$$\Delta\theta_{SL} = \begin{cases} \theta_R - \theta_L & \text{if } \theta'_s \geq \theta'_{s_{\min}} \\ \pi - \theta_R + \theta_L & \text{if } \theta'_s < \theta'_{s_{\min}} \end{cases} \tag{17}$$

Since in Dolph-Tchebysheff arrays $x_0$ is a function of the desired sidelobe ratio and the number of elements as given in equation (5), the above formulas yield the direct relationship between the steering direction and the beamwidth. In other words, in the classic design, the beamwidth is a function of the steering direction $\theta_S$, the number of elements in the array L, its inter-element spacing $\Delta e$ and the desired sidelobe ratio SLRv. Moreover, it was shown in [1] that, for fixed $\theta_S$, L, $\Delta e$ and SLRv, the beamwidth of the Dolph-Tchebysheff array is the minimum possible. FIG. 3 shows the −40 dB Dolph-Tchebysheff patterns of a ULA with 20 elements. It can be seen how the mainlobe's shape change (gets distorted) as it is steered to angles closer to the end-fire.

Next, consider the application of conventional Dolph-Tchebysheff to a UCA, as proposed in [2]. For convenience, a brief review of the necessary formulas and procedures is given below. Be the steering vector of a uniform circular array of omni-directional elements and minimum inter-element distance equal to $\Delta e$ be:

Equation 18

$$a(\theta) = \left[e^{-j\frac{2\pi R}{\lambda}\cos\left(\frac{2\pi(i-1)}{L}\theta\right)}\right]_{i=1,\ldots,L-1} \tag{18}$$

where $R=\Delta e\lambda/2\sin(\pi/L)$. Define the matrix F by:

Equation 19

$$F = \frac{1}{\sqrt{L}}\begin{bmatrix} 1 & \omega^{-h} & \cdots & \omega^{-(L-1)h} \\ \vdots & \vdots & \cdots & \vdots \\ 1 & \omega^{-1} & \cdots & \omega^{-(L-1)} \\ 1 & 1 & \ldots & 1 \\ 1 & \omega^{1} & \cdots & \omega^{(L-1)} \\ \vdots & \vdots & \cdots & \vdots \\ 1 & \omega^{h} & \cdots & \omega^{(L-1)h} \end{bmatrix} \tag{19}$$

where $\omega = e^{j2\pi/L}$ and

Equation 20

$$h = \max\left\{h \leq \frac{L-1}{2}\left|\frac{\left|J_{h-L}\left(\frac{2\pi R}{\lambda}\right)\right|}{\left|J_h\left(\frac{2\pi R}{\lambda}\right)\right|} \leq \varepsilon << 1\right.\right\} \tag{20}$$

Define the matrix J by:

Equation 21

$$J = diag\left\{\left(j^m\sqrt{L}\,J_m\left(\frac{2\pi R}{\lambda}\right)\right)^{-1}\right\} \tag{21}$$

with $m=-h, \ldots, o, \ldots, h$ and where $J_{-m}(x)=(-1)^m J_m(x)$.

Then, if right-multiply JF to $a(\theta)$, the following can be obtained.

Equation 22

$$A(\theta)=JF\check{a}(\theta)=[e^{-jh\theta} \ldots 1 \ldots e^{jh\theta}]. \tag{22}$$

Observe that the resulting steering vector is similar to the steering vector of a linear array, except that now the elements of $A(\theta)$ are no longer dependent on $\cos(\theta)$, on $\theta$directly.

Using of this transformation the design of Dolph-Tchebysheff current distributions for a UCA is possible, and the beamwidth of this pattern is not dependent on $\theta$. It was shown in [2] that, in this case, equation (17) reduces to:

Equation 23

$$\Delta\theta_{SL} = \theta_R - \theta_L = 4\ \arccos\left(\frac{1}{x_{peak}}\right) \tag{23}$$

Once the virtual ULA transformed from an L-elements UCA has 2h+l elements as shown in [2], equation (5) reduces to Equation 24

$$x_{peak} = x_0 = \cosh\left(\frac{\operatorname{arccosh}(SLR_v)}{2h}\right). \tag{24}$$

Therefore for the classic Dolph-Tchebysheff UCA, it gives:

Equation 25

$$\Delta\theta_{SL} = \theta_R - \theta_L = 4\arccos\left(\frac{1}{\cosh\left(\frac{\operatorname{arccosh}(SLRv)}{2h}\right)}\right). \tag{25}$$

The above expression clearly shows, as previously stated, that in the scheme proposed in [2], the beamwidth of the low sidelobe pattern independent of $\theta_S$, being a function of the number of elements, the inter-element spacing and the prescribed sidelobe ratio. FIG. 4 illustrates the result delivered by the technique proposed in [2], showing the beampatterns obtained with a UCA of 35 elements and half wavelength inter-element spacing (what gives h=15), steered to 0° and 60°. As expected, it can be seen that there is no distortion caused by steering.

The drawback of such design, however, is that since a UCA has an aperture narrower than that of a ULA with the same number of elements and the same inter-element spacing, the beamwidth of the beamformer proposed in [2], that is, $\Delta\theta_{SL}$ given in equation (25), is significantly larger than that of the Dolph-Tchebysheff beampattern given in equation (17), with a ULA not only at broadside exactly, but within a significantly large angular span around it. FIG. 5 clarifies this fact by showing the curves of beamwidth against steering direction of ULA and UCA Dolph-Tchebysheff beampatterns with L=20 and $\Delta e=0.5\lambda$ for prescribed −20 dB and −40 dB sidelobe ratios. It is seen that the price paid for a rotation-invariant mainlobe obtained with a UCA is the significant enlargement of the beamwidth. From all the explained in this section it is possible to conclude the following about conventional Dolph-Tchebysheff array design:

1) There is no way to adjust the mainlobe's width to a desired value (beyond a practical minimum) without interfering on the sidelobe.

2) If ULA is used, given L, SLR and Δe, the mainlobe's width varies as a function of the steering direction.
3) If UCA is used, the mainlobe's width is much larger than that of a ULA with the same L, SLR and Δe.

Following is a list of the literature mentioned above:

[1] C. L. Dolph: "A Current Distribution for Broadside Arrays Which Optimizes the Relationship Between Beamwidth and Sidelobe Level", Proc. IRE, 34(6), pp. 335–348, 1946.
[2] B. K. Lau and Y. H. Leung: "A Dolph-Chebyshev Approach to the Synthesis of Array Patterns for Uniform Circular Arrays", Proc. ISCAS 2000, vol. I, pp. 124–127, May 2000.
[3] R. J. Stegen: "Excitation Coefficients and Beamwidths of Tchebysheff Arrays", Proc. IRE, 40(11), pp.1671–1674, 1953.
[4] T. N. Davidson: "A Note on the Calculation of Dolph-Chebyshev Shading for Linear Array", ASPL-1991-3, Dept. Electrical and Electronic Eng., the University of Western Australia, Aug, 1991.
[5] S. Jazi: "A New Formulation for the Design of Chebyshev Arrays", IEEE Trans. Antennas and Propagations, 42(3), pp.439–443, 1994.
[6] S. Jazi: "Modified Chebyshev Arrays", IEE Proc. on Microwaves, Antennas and Propagations, vol.145, no.1, February 1998.
[7] D. E. N. Davies: "A Transformation Between the Phasing Technique Required for Linear and Circular Aerial Arrays", Proc. IEE 112(11), pp.2041–2045, 1965.
[8] Y. Y. Lo and S. W. Lee: "Antenna Handbook. Theory, Applications and Design", VNR, 1988.

The present invention was made in consideration with the above circumstances and has as an objective thereof to provide an array antenna capable of forming a beampattern with an adjustable beamwidth and low sidelobes ratio.

Means for Solving the Problem

To achieve the above object, according to the present invention, there is provided an array antenna comprising a plurality of antenna elements, a calculation means for calculating excitation coefficients for each said antenna element in a way such that said antenna elements form a beampattern having a flat top mainlobe of adjustable beamwidth and a predetermined sidelobe level.

Further, according to the present invention, there is provided an array antenna comprising a plurality of antenna elements, a calculation means for calculating excitation coefficients $A_n$ for each said antenna element in accordance with $$A_n = \sum_{m=1}^{L} G\left(L-1, x_p\cos\left(\frac{\pi m}{L}\right), \alpha, \beta\right) e^{-j(2n-L-1)\frac{\pi m}{L}} \tag{36}$$

where the function G(N,x,α,β) is given as $$G(N,x,\alpha,\beta) = \begin{cases} \cos(N(\beta - e^{\alpha|x|})\arccos(x)) & \text{if } |x| \le 1 \\ \cosh(N(\beta - e^{\alpha|x|})\operatorname{arccosh}(x)) & \text{if } |x| \ge 1 \end{cases}. \tag{26}$$

Preferably, according to the present invention, said antenna elements form a uniform linear array.

Preferably, according to the present invention, said antenna elements form a uniform circular array.

EMBODIMENT OF THE INVENTION

Figure 6:
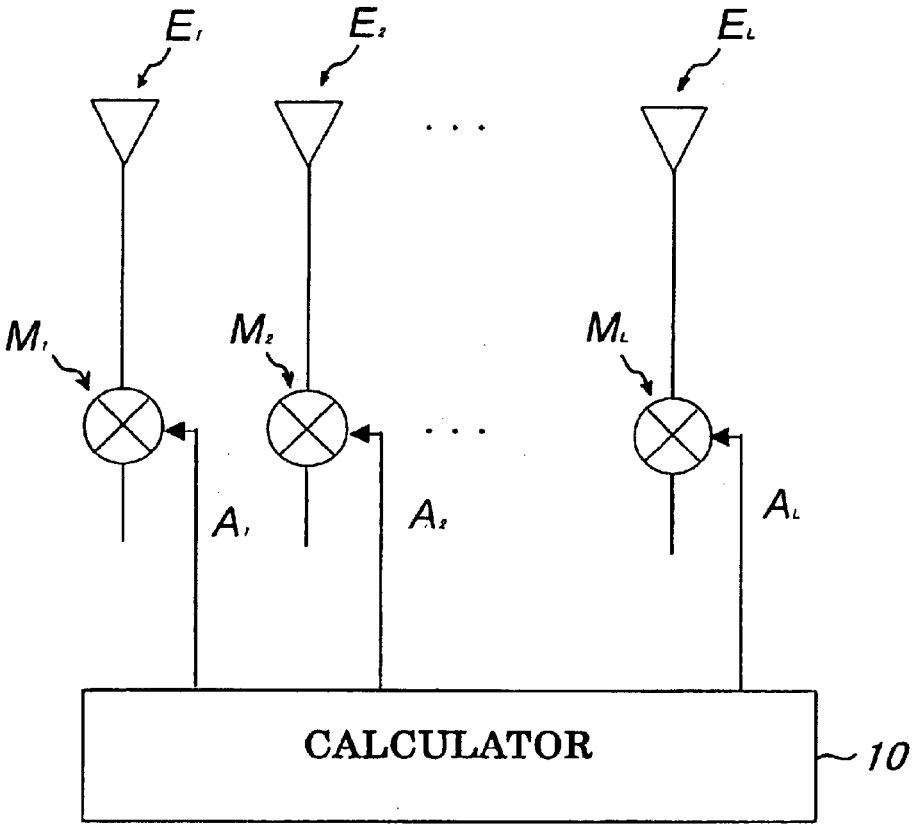
FIG. 6 is a diagram showing a configuration of the array antenna of an embodiment according to the present invention.

FIG. 6 shows an example of the configuration of the array antenna according to an embodiment of the present invention. As illustrated in FIG. 6, the array antenna of the present embodiment is constituted by L antenna elements $E_1$, $E_2$, . . . , $E_L$, L complex multipliers $M_1$, $M_2$, . . . , $M_L$, and a calculator 10 for calculating the coefficients $A_1$, $A_2$, . . . , $A_L$ for each antenna element.

In the present invention, the L elements form a ULA, that is the L elements are located in a line with the same inter-element space, or a UCA, that is the L elements are located in a circle with the same inter-element space.

The calculator 10 calculates the complex coefficients $A_1$, $A_2$, . . . , $A_L$ for each antenna elements. When the array antenna is used for reception, the received signal of each element is multiplied by the complex coefficients $A_1$, $A_2$, . . . , $A_L$ at each multiplier and the products of each multiplier are added to form the reception signal. On the other hand, when the array antenna is used for transmission, the signal to be sent is supplied to each multiplier, the products of the input signal with the coefficients of each multiplier are output to each antenna element and transmitted.

Below, an explanation of the operation of the calculator 10 for calculating the coefficients of $A_1$, $A_2$, . . . , $A_L$ for the each multiplier will be given.

First, it begins by recalling that if the monotonic behavior of the Tchebysheff polynomial for |x|>1 were removed while maintaining the limited amplitude in the interval x∈[−1, 1], a Tchebysheff-like pattern with adjustable beamwidth can be obtained. Thus, it is proposed to replace the Tchebysheff polynomial by the function:

Equation 26

$$G(N, x, \alpha, \beta) = \begin{cases} \cos(N(\beta - e^{\alpha|x|})\arccos(x)) & \text{if } |x| \le 1 \\ \cosh(N(\beta - e^{\alpha|x|})\arccos h(x)) & \text{if } |x| \ge 1 \end{cases}. \quad (26)$$

Clearly, if $\alpha=0$ and $\beta=2$, the proposed function reduces to the Tchebysheff polynomial. However, $N(\beta-e^{\alpha|x|})\arccos(x)$ vanishes if $\beta=e^{\alpha|x|}$, case in which $\ni x|(N,x,\alpha,\beta)=1$. As a consequence, by choosing appropriate $\alpha$ and $\beta$, an inflexion point can be added outside $x \in[-1,1]$, more precisely in the interval $|x|\in[1, \ln(\beta)/\alpha]$.

Figure 7:
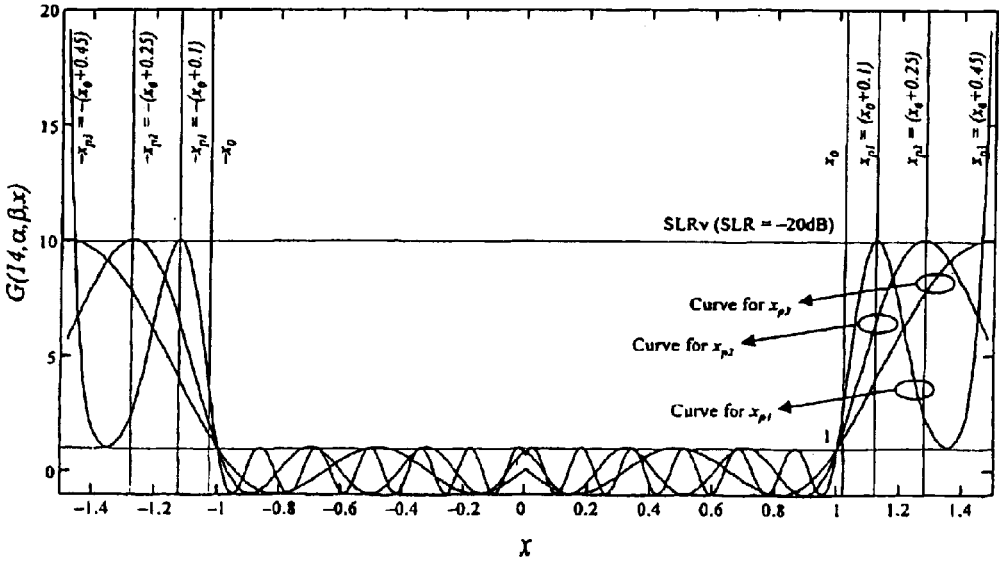
FIG. 7 is a diagram showing the value of the proposed extended function for different $x_p$.

On the other hand, within the interval $x\in[-1,1]$, the term $(\beta-e^{\alpha|x|})$ does nothing more than cause changes on the number and positions of zeros of $\cos(N(\beta-e^{\alpha|x|})\arccos(x))$, once this function is limited to the values $[-1,1]$. These features are illustrated in FIG. 7.

Thus, the proposed beampattern design involves the optimization of $\alpha$ and $\beta$ so to place the inflection point at the value of $x_p>x_0$ (that determines a beamwidth, obviously lower-bounded by the Dolph-Tchebysheffs one), while adjusting the peak value to the desired SLR. This is achieved by putting Equation 27

$$G(N,x_p,\alpha,\beta)=\cos h(N(\beta-e^{\alpha|x_p|})arccosh(x_p))=SLRv \quad (27)$$

what yields

Equation 28

$$(\beta - e^{\alpha|x_p|})\text{arccosh}(x_p) = \frac{\text{arccosh}(SLRv)}{N}. \quad (28)$$

Next, by taking

Equation 29

$$\frac{\partial G(N,x,\alpha,\beta)}{\partial x}\Big|_{x_p} = \left[\frac{N(\beta - e^{\alpha|x_p|})}{\sqrt{x_p^2-1}} - N\alpha e^{\alpha|x_p|}\arccos h(x_p)\right] \times \sin h(N(\beta - e^{\alpha|x_p|})\arccos h(x_p)) = 0 \quad (29)$$

the following can be obtained.

Equation 30

$$\frac{(\beta - e^{\alpha|x_p|})}{\sqrt{x_p^2-1}} = \alpha e^{\alpha|x_p|}\arccos h(x_p). \quad (30)$$

By substituting (28) into (30), the following can be given:

Equation 31

$$\alpha e^{\alpha|x_p|} = \frac{\arccos h(SLRv)}{N\sqrt{x_p^2-1}\ \arccos h^2(x_p)}. \quad (31)$$

The above equation allows for the optimization of a independently from $\beta$, and can be achieved by a simple linear regression. To this end the equation (31) is first rewritten as Equation 32

$$\ln(\alpha)=\ln(P)-\alpha|x_p| \rightarrow \alpha=e^{ln(P)-\alpha|x_p|} \quad (32)$$

where P is given as following.

Equation 33

$$P = \frac{\arccos h(SLRv)}{N\sqrt{x_p^2-1}\ \arccos h^2(x_p)}. \quad (33)$$

Then, the regression can then be done by repeatedly computing:

Equation 34

$$\alpha_{k+1}=e^{ln(P)-\alpha_k|x_p|} \quad (34)$$

Finally, $\beta$ can be calculate from:

Equation 35

$$\beta = e^{\alpha|x_p|} + \frac{\arccos h(SLRv)}{N\ \arccos h(x_p)}. \quad (35)$$

Once $\alpha$ and $\beta$ are calculated, the function is mapped into the array factor as in the classic Dolph design, that is, the current distribution can then be calculated using the inverse Fourier Transform. For an ULA with L elements and inter-element spacing $\Delta e$, the excitation coefficient $A_n$ of the n-th antenna element is given by Equation 36

$$A_n = \sum_{m=1}^{L} G\left(L-1, x_p\ \cos\left(\frac{\pi m}{L}\right), \alpha,\ \beta\right)e^{-j(2n-L-1)\frac{\pi m}{L}} \quad (36)$$

where n=1, 2, . . . , L. If the phases of the signals at all elements are driven so to steer the mainlobe's peak towards an angle $\theta_S$, the resulting beampattern will exhibit a space factor approximately as given below.

Equation 37

$$|G(L-1,x_p\ \cos(\pi\Delta e(\cos(\theta)-\cos(\theta_s))),\alpha,\beta)| \quad (37)$$

The reason why the beampattern of the proposed design method is not exactly identical to that given in equation (37) results from the fact that the basic function given in equation (26) is not a polynomial. Therefore, for a number L of elements, the true beampattern will be actually given by the Fourier series of equation (37), truncated after L-terms. However, it is consistently verified via simulations that the error incurred in using equation (37) is negligible, either because when L is large enough the truncation does not greatly affect the final value of the Fourier series, or because when L is not that large these errors appear as differences in the sidelobe region more often in terms of the number and location of nulls and sidelobes, then in terms of their level.

Figure 1:
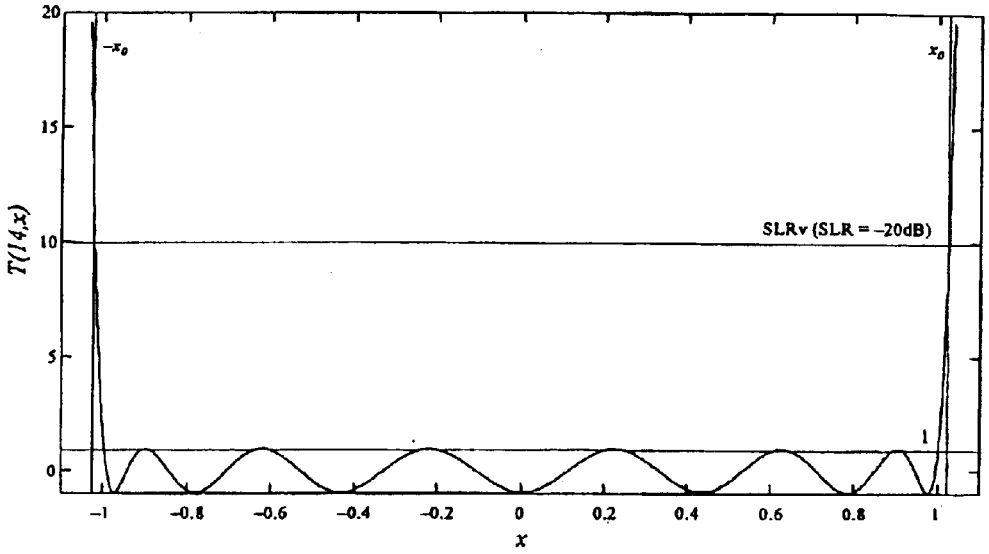
FIG. 1 is a diagram showing the value of Tchebysheff polynomial of 14th order.
Figure 2:
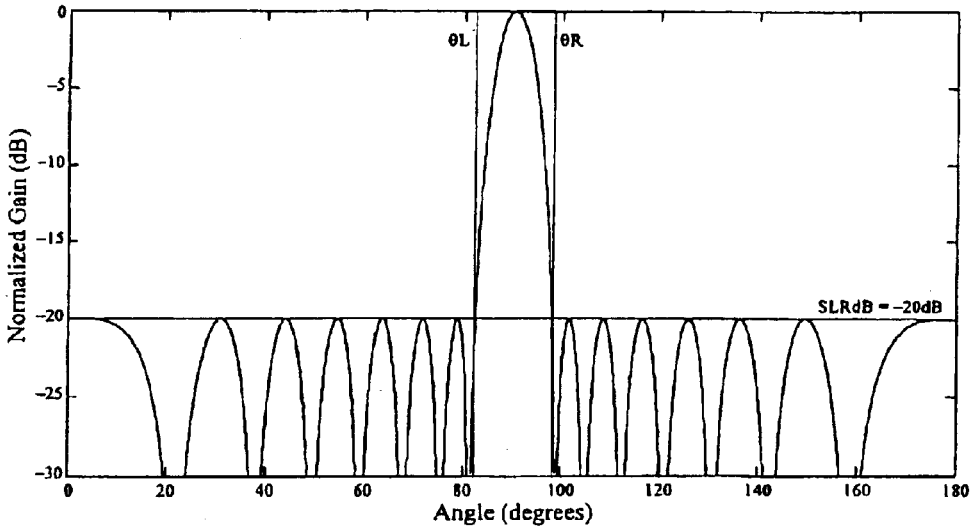
FIG. 2 is a diagram showing a conventional Tchebysheff beampattern with L=15.
Figure 3:
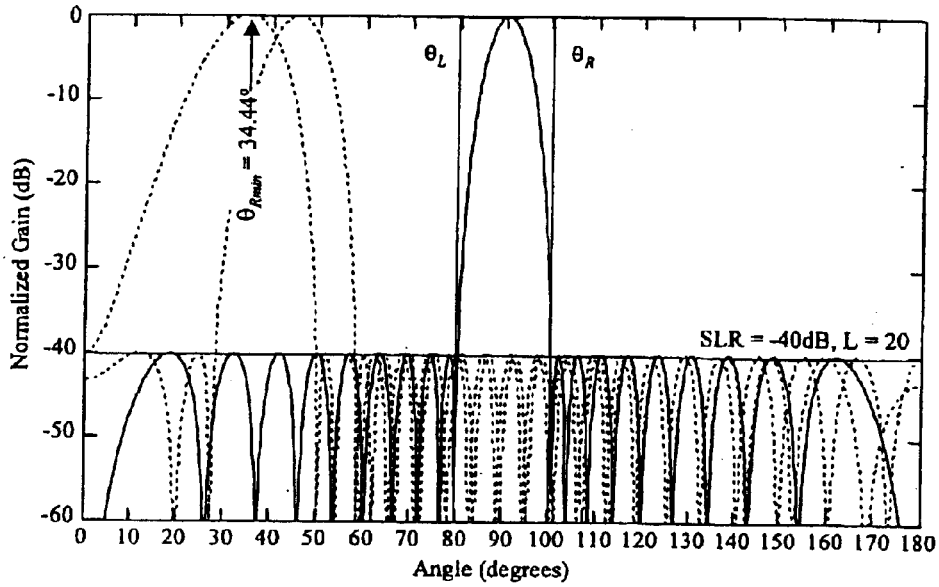
FIG. 3 is a diagram showing steered classic Dolph-Tchebysheff beampatterns of a ULA with L=20.
Figure 4:
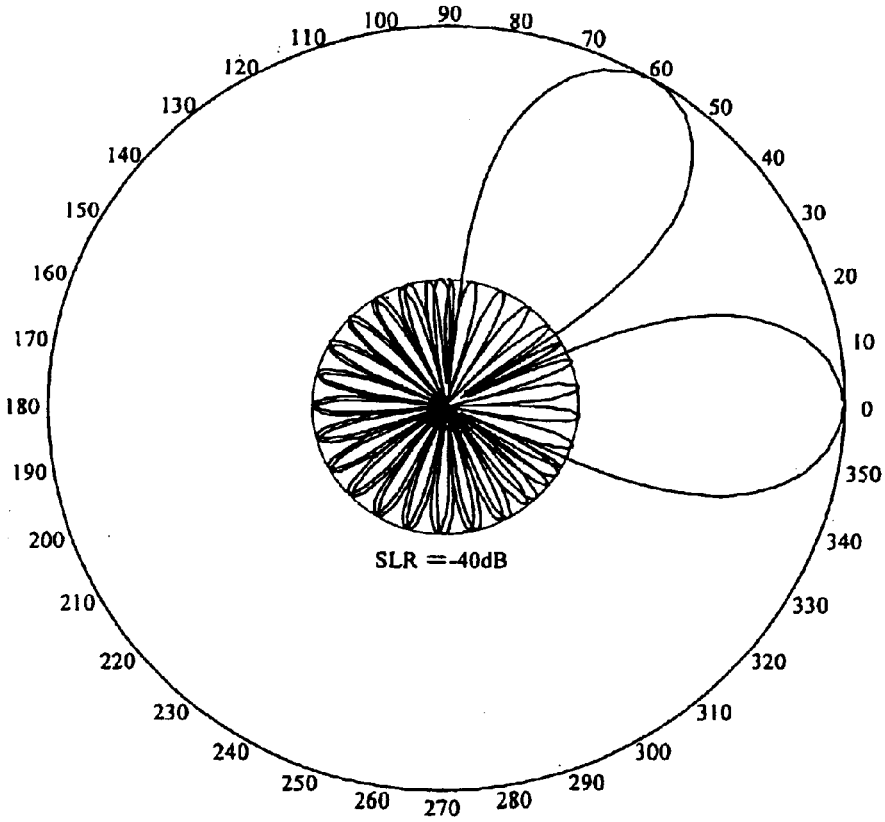
FIG. 4 is a diagram showing steered classic Dolph-Tchebysheff beampatterns of a UCA with L=35.
Figure 5:
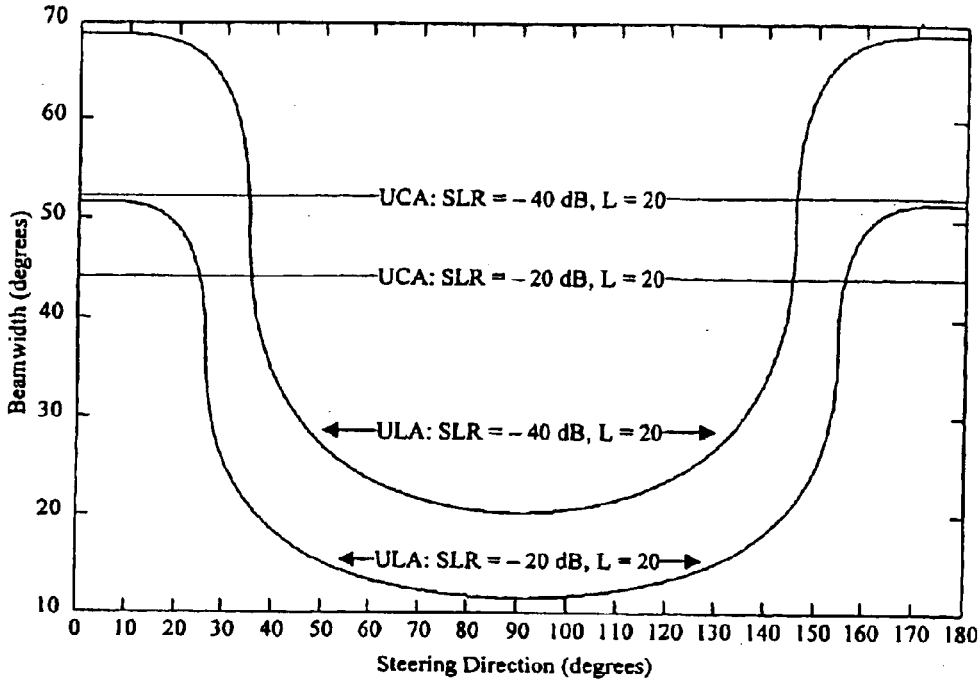
FIG. 5 is a diagram showing the beamwidth of the conventional Dolph-Tchebysheff with ULA and UCA against steering direction.
Figure 8:
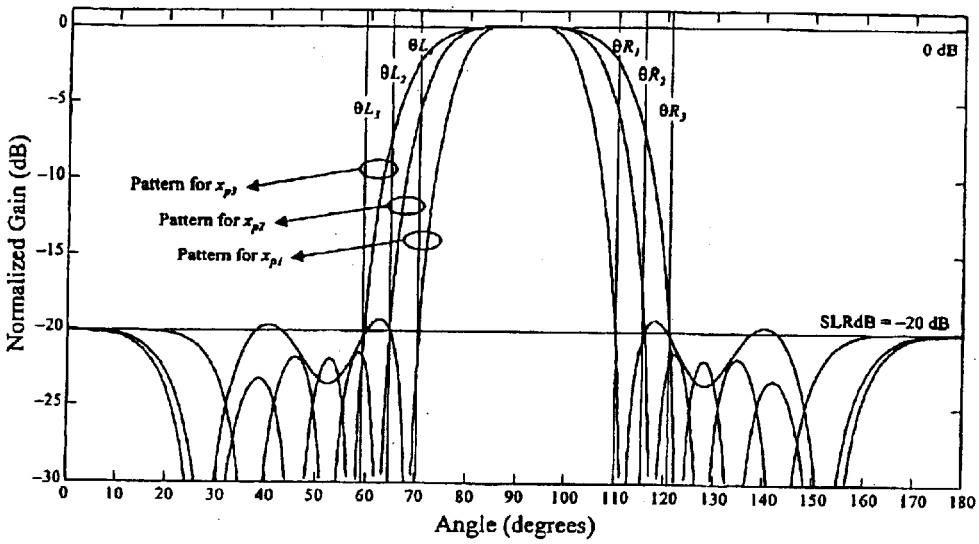
FIG. 8 is a diagram showing the beampatterns of the proposed method with a ULA.

FIG. 8 illustrates the effect of the choice of $x_p$ in the proposed design method with the mainlobe steered to broadside ($\theta_S$=90°). It is seen that the enlarged mainlobe has the additionally desirable characteristic of exhibiting a flattop when $x_p$ is large enough. This is expected and can be understood by comparing the plot of the Tchebysheff polynomial (FIG. 1) with the array factor resulting from its mapping into a ULA (FIG. 2), from what it is seen that although the polynomial is monotonically increasing in x>1, the mainlobe has obviously a maximum at its center due to the non-linear mapping relationship between x and $\theta$ given below.

Equation 38

$$x=x_p \cos(\pi\Delta e(\cos(\theta))). \tag{38}$$

Note that, like the Tchebysheff polynomial, the proposed function returns 1 at x=1, independently of the values of N, $\alpha$ and $\beta$. This means that the previous definitions of the sidelobe level beamwidth ($\Delta\theta_{SL}$) are equally applicable for the proposed design method. However, unlike the classic Dolph-Tchebysheff, in the proposed design method, the value of $x_{peak}=x_p$ in equations (9)–(16) and (23) can be freely chosen ($x_p \geqq x_0$) and therefore the beamwidth can be adjusted (enlarged) as desired. For instance, if the proposed design method is applied to a UCA, equation (31) becomes:

Equation 39

$$\Delta\theta_{SL} = 4 \arccos\left(\frac{1}{x_p}\right). \tag{39}$$

In other words, for any desired $\Delta\theta_{SL}$ grater than that given by equation (25), equation (39) yields the calculation of a value of $x_p>x_0$, i.e.:

Equation 40

$$x_p = \frac{1}{\cos\left(\frac{\Delta\theta_{SL}}{4}\right)}. \tag{40}$$

Figure 9:
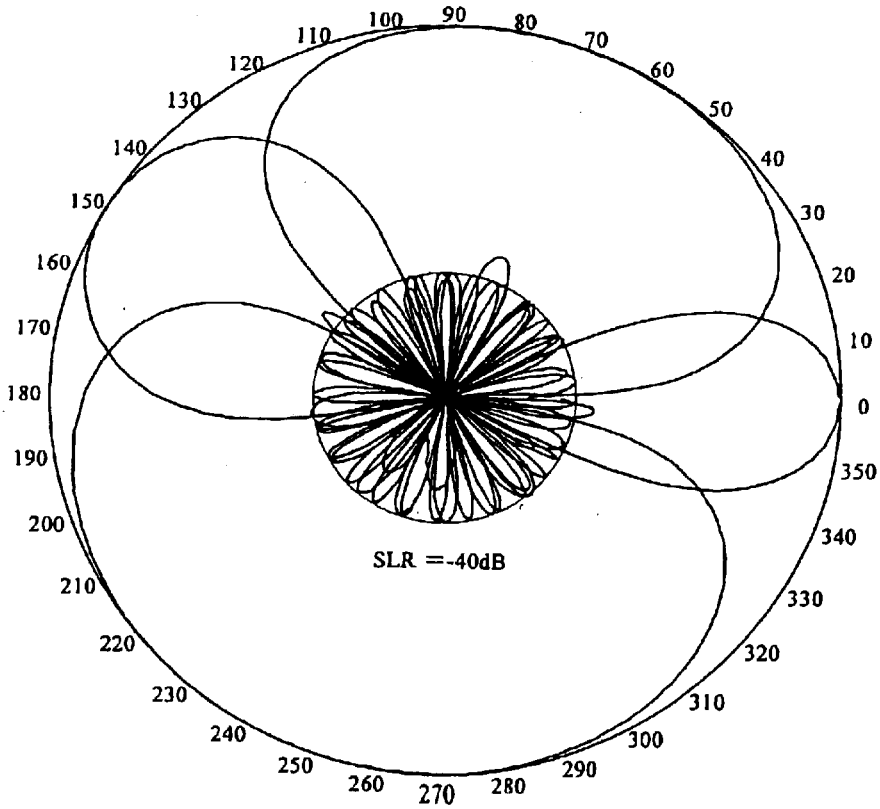
FIG. 9 is a diagram showing the steered proposed beampatterns of a UCA with L=35.

Once the value of $x_p$ that results in the desired beamwidth is known, it is then introduced as a parameter in the appropriate equations of the proposed beamformer (31)–(36). FIG. 9 demonstrates the flexibility obtained with the proposed design method applied to a UCA. Four different beampatterns are displayed, all with the same sidelobe level (−40 dB) obtained with a UCA of 35 elements and half wavelength inter-element spacing, but with different steering directions and beamwidths. It can be seen that the adjustability of the mainlobe's beamwidth comes at the expense of raising the possibility of obtaining patterns with non-equiripple sidelobes, but that the prescribed sidelobe level is rarely and, when so, only slightly violated.

Figure 10:
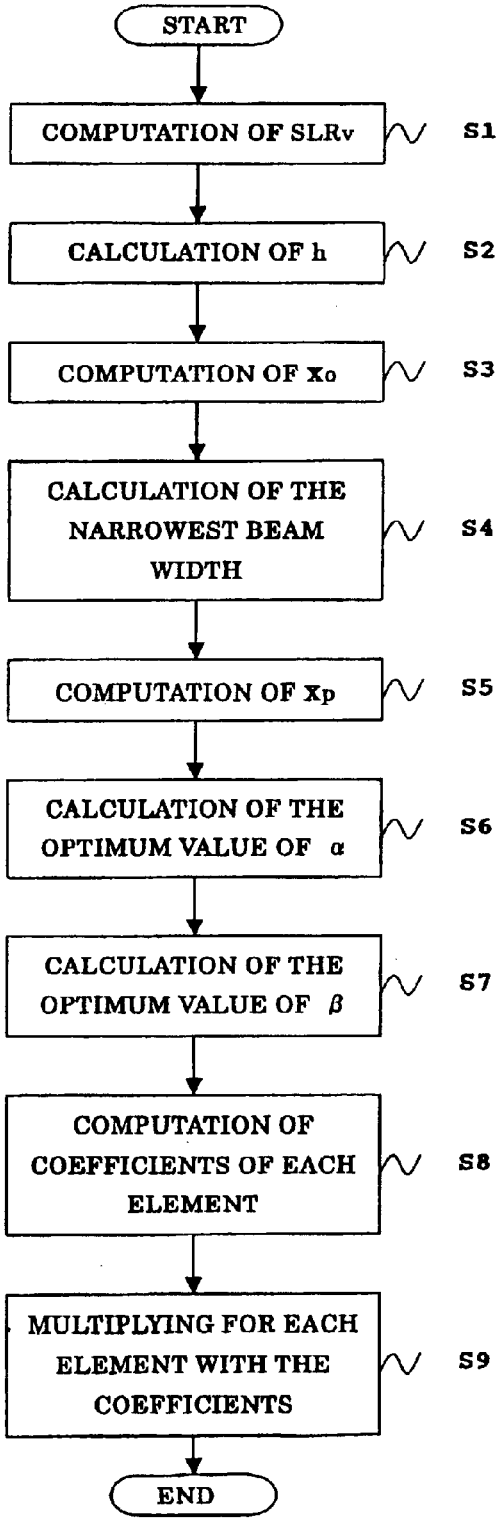
FIG. 10 is a flow chart showing the proposed design method of a UCA.

The proposed design method applied to a UCA can be summarized with steps shown in FIG. 10 (given L, $\Delta e$, SLRdB, $\Delta\theta$ and $\theta_S$).

Below, the steps of the design method will be explained by referring to FIG. 10.

Step S0: Use equation (4) to compute SLRv.

Step S2: Use equation (20) to calculate h.

Step S3: Use equation (24) to compute the value of $x_0$ associated to the narrowest beamwidth.

Step S4: Use equation (25) to calculate the narrowest possible beamwidth.

Step S5: For a desired beamwidth larger then the one calculated in the step above, use equation (40) to compute the value of $x_p$ associated to it.

Step S6: Use equation (34) to calculate the optimum value of $\alpha$.

Step S7: Use equation (35) to compute the optimum value of $\beta$.

Step S8: Use equation (36) to compute the current distribution.

Step S9: Multiply every element of the transformed steering vector of equation (22) towards $\theta_S$. with the correspondent current distribution obtained above.

The application of the proposed beamforming method to ULA's, however, involves another issue. Obviously, it is impossible to avoid the deformation caused by steering towards anywhere else rather than broadside, but as what will be demonstrated, the extended Tchebysheff design hereby proposed can be used to allow an almost perfectly rotation-invariant low sidelobe scanning of a limited range with a ULA. Note, however, that unlike the UCA case, a value of $x_p$ associated to a desired beamwidth cannot be calculated directly. In order to derive a method to calculate $x_p$, a revisiting of the expressions for the beamwidth of the steered extended Tchebysheff will be made. By assuming that:

Equation 41

$$A = \frac{1}{\pi\Delta e}\arccos\left(\frac{1}{x_p}\right) - \cos(\theta_s); \tag{41}$$

Equation 42

$$B = \frac{1}{\pi\Delta e}\arccos\left(\frac{1}{x_p}\right) + \cos(\theta_s). \tag{42}$$

Then, within the limits $\theta'_s>\theta'_{smin}$, from equations (12), (13) and (17), the following equation can be given:

Equation 43

$$\Delta\theta_{SL}=\pi-arccos(A)-arccos(B). \tag{43}$$

Substituting equations (41) and (42), it gives:

Equation 44

$$B=-A\cos(\Delta\theta)+\sin(\Delta\theta)\sin(arccos(A)). \tag{44}$$

Since $B=A+2\cos(\theta_s)$, it gives:

Equation 45

$$A_{k+1}=-2\cos(\theta'_s)-A_k\cos(\Delta\theta)+\sin(\Delta\theta)\sin(arccos(A_k)). \tag{45}$$

Proceeding in a similar way, it can be derived:

Equation 46

$$B_{k+1}=2\cos(\theta'_s)-B_k\cos(\Delta\theta)+\sin(\Delta\theta)\sin(arccos(B_k)). \tag{46}$$

For given values of $A_k$ and $B_k$, equations (41) and (42) yield respectively:

Equation 47

$$x_p = \frac{1}{\cos(\pi\Delta e(A_k + \cos(\theta'_s)))}; \tag{47}$$

Equation 48

$$x_p = \frac{1}{\cos(\pi\Delta e(B_k - \cos(\theta'_s)))}. \tag{48}$$

Figure 11:
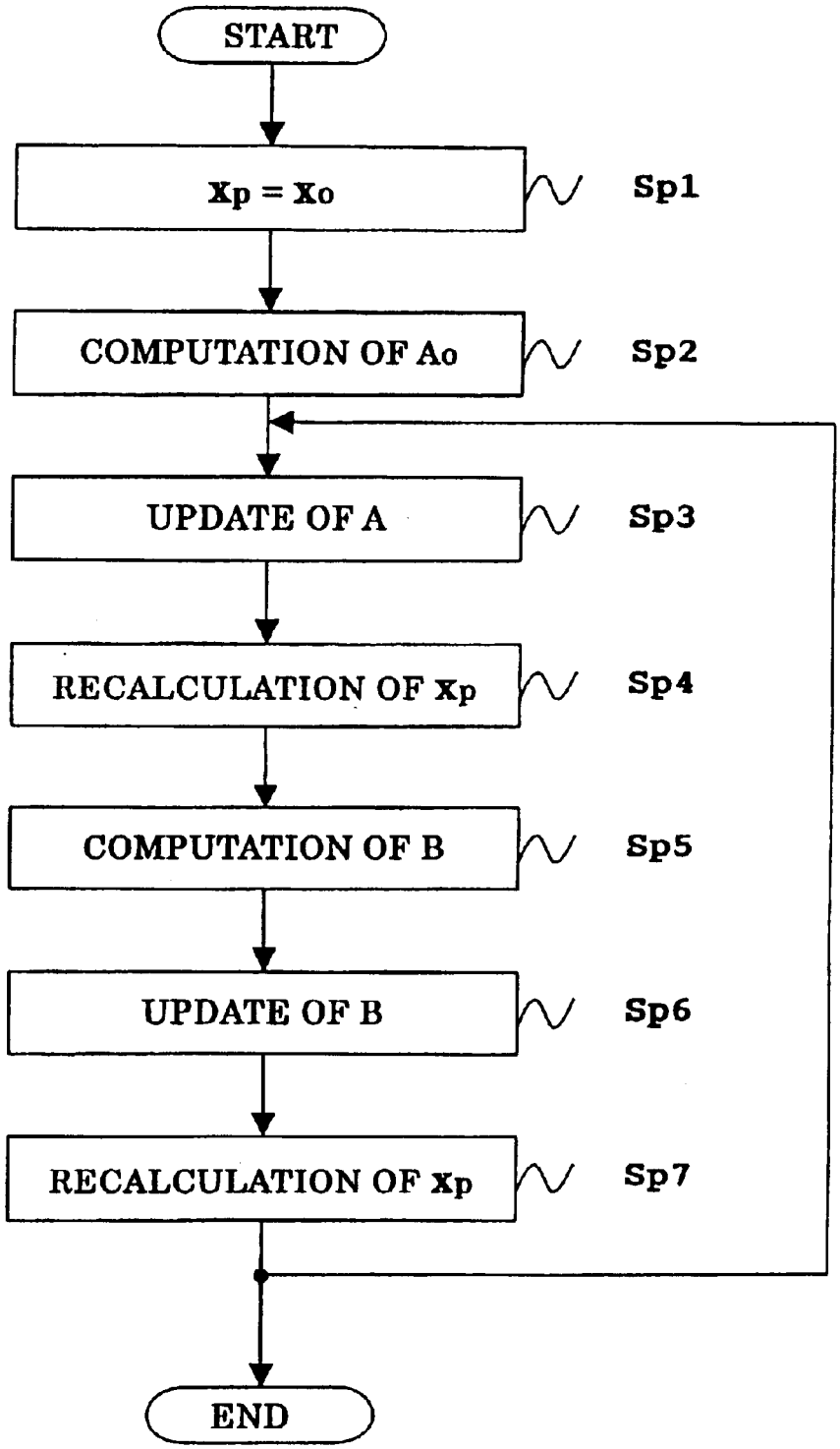
FIG. 11 is a flow chart showing the procedure for computing the value of $x_p$.

The above equations allow for a simple recursive procedure to compute the value of $x_p$ necessary to obtain a mainlobe of width $\Delta\theta$ steered towards $\theta_s$ as shown in FIG. 11.

Below, the procedure of the computation will be given with reference to FIG. 11.

Step Sp1: Start with $x_p=x_o$,

Step Sp2: Use equation (41) to compute $A_o$,

Step Sp3: Use equation (45) to update A,
Step Sp4: Use equation (47) to recalculate $x_p$,
Step Sp5: Use equation (42) to compute B,
Step Sp6: Use equation (46) to update B,
Step Sp7: Use equation (48) to recalculate $x_p$,
then go back to step Sp3.

The above calculations are verified to converge extremely quickly and stably to the desired value of $x_p$. In fact, the convergence can be made even faster if one observes that the values of $x_p$ are bounded by the ones associated to broadside and to end-fire, respectively. Making $\theta_s$=90° in equation (43), it can be derived:

Equation 49

$$x_{p\max} = \frac{1}{\cos\left(\frac{1}{\pi\Delta e}\cos\left(\frac{\pi-\Delta\theta}{2}\right)\right)}. \tag{49}$$

For the sake of concision, we also derive the formulas to compute the values of $x_p$ necessary to obtain a mainlobe of beamwidth $\Delta\theta$ steered to angles below $\theta_{smin}$.

Analogously to the above, let A be as in equation (41) and B now be given by:

Equation 50

$$B = \frac{1}{\pi\Delta e}\arccos\left(\frac{-1}{x_0}\right) - \cos(\theta_s'). \tag{50}$$

Since arccos(−x)=π−arccos(x), it can be given:

Equation 51

$$A = -B + \frac{1}{\Delta e} - 2\cos(\theta_s'). \tag{51}$$

Then, from equations (15) to (17) it can be given for $\theta'_s<\theta'_{smin}$:

Equation 52

$$A_{k+1} = \frac{1}{\Delta e} - 2\cos(\theta_s') + A_k\cos(\Delta\theta) - \sin(\Delta\theta)\sin(\arccos(A_k)); \tag{52}$$

Equation 53

$$B_{k+1} = \frac{1}{\Delta e} - 2\cos(\theta_s') + B_k\cos(\Delta\theta) + \sin(\Delta\theta)\sin(\arccos(B_k)). \tag{53}$$

Figure 12:
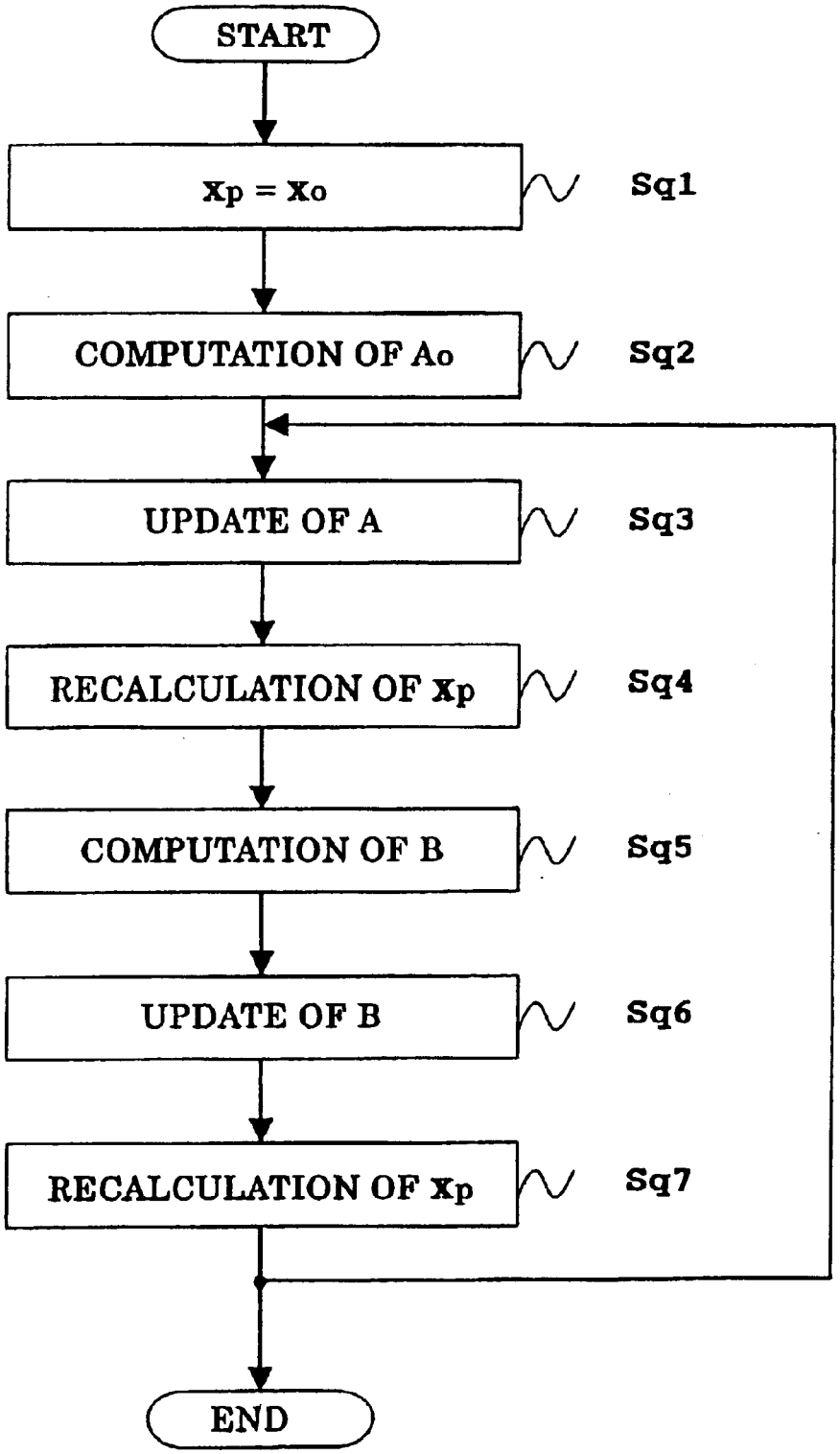
FIG. 12 is a flow chart showing the new procedure for computing the value of $x_p$.
Figure 13:
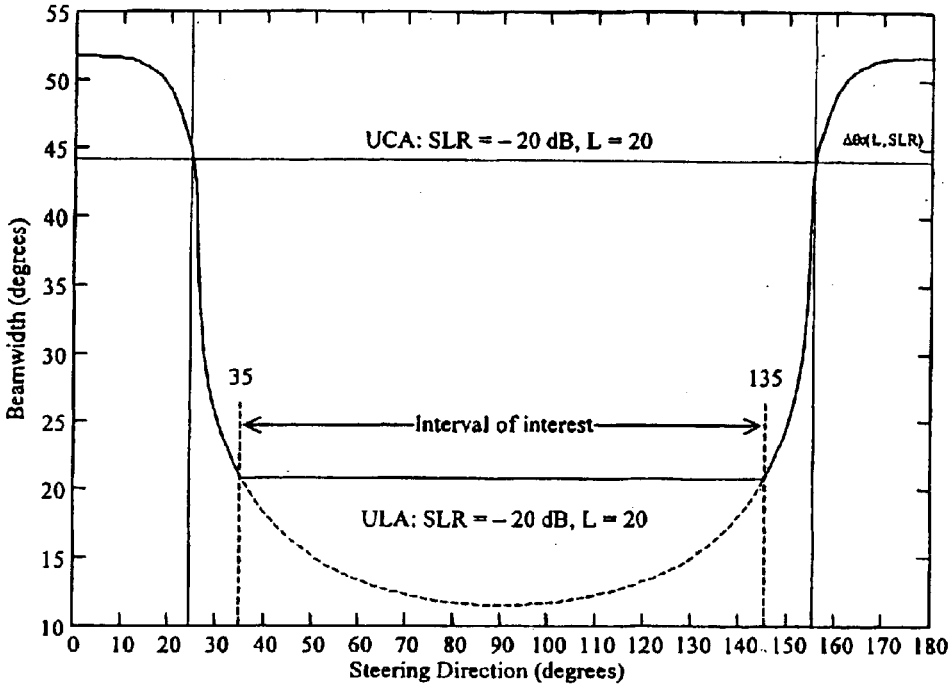
FIG. 13 is a diagram showing the beamwidth of proposed beamformer with ULA and of conventional Dolph-Tchebysheff with ULA and UCA aginst steering direction.

FIG. 12 shows the recursive procedure to compute the value of $x_p$. Below, the procedure will be explained with reference to FIG. 12.

Step Sq1: Start with $x_p=x_o$,
Step Sq2: Use equation (41) to compute $A_O$,
Step Sq3: Use equation (52) to update A,
Step Sq4: Use equation (47) to recalculate $x_p$,
Step Sq5: Use equation (50) to compute B,
Step Sq6: Use equation (53) to update B.
Step Sq7: Use equation (48) to recalculate $x_p$,
then go back to step Sq3.

Similarly to before, the lower bound on the value of $x_p$ is given below.

Equation 54

$$x_{p\min} = \frac{1}{\cos\left(1 + \frac{1}{\pi\Delta e}\cos\left(\pi - \frac{\Delta\theta}{2}\right)\right)}. \tag{54}$$

FIGS. 13 to 16 illustrate the possibilities of the proposed beamforming algorithm with a ULA, with respect to the application of performing uniform scanning of a limited angular range with a rotation invariant low sidelobe beampattern. First, in FIG. 13, a 20-element ULA is used and the prescribed sidelobe level is −20 dB. There, the beamwidth curve of the proposed beamformer is contrasted to those of the conventional Dolph-Tchebysheff and of the method proposed in [2], where an interval of interest between 35°–145° is set and the objective is to scan it with a beamwidth-invariant pattern. It is seen that the hereby-proposed algorithm delivers the best possible trade-off between the beamwidth and the invariance of the mainlobe. Indeed, with the proposed method a mainlobe with a width of approximately 21° is achieved, against an almost 45° wide mainlobe obtained with the technique in [2].

Figure 14:
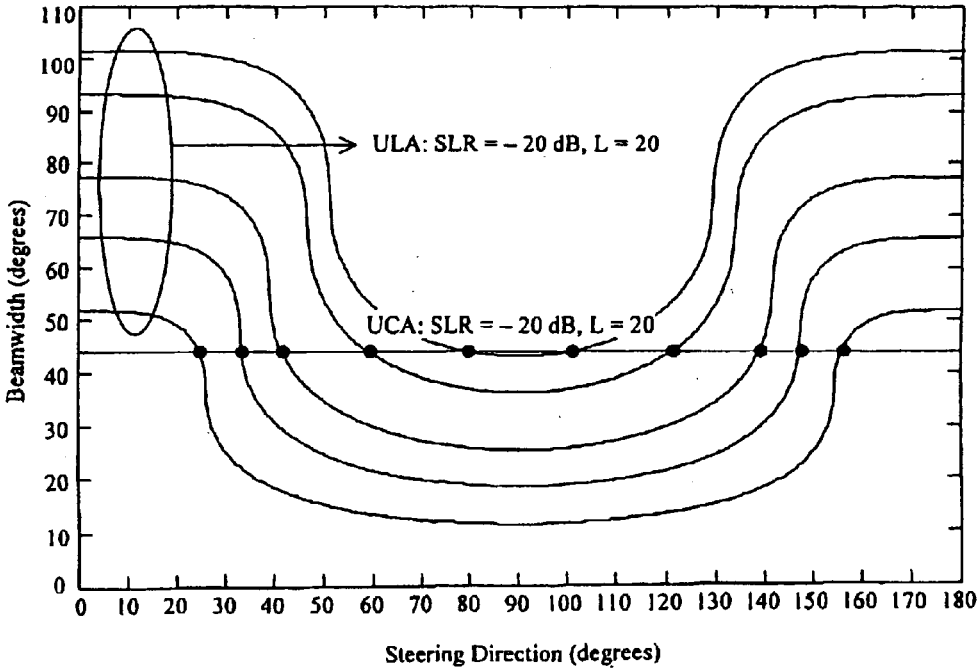
FIG. 14 is a diagram showing the beamwidth of proposed beamformer with ULA for different $x_p$ and of conventional Dolph-Tchebysheff beamformer with UCA against steering direction.

In order to provide an understanding of the idea behind the above result, in FIG. 14 the beamwidth curve of the steered −20 dB conventional Tchebysheff pattern of a 20-element UCA is compared to those of the extended ULA Tchebysheff patterns of the same size, with various values of $x_p \geqq x_o$. It is seen that the extended design encompasses a family of curves covering the whole region above that of the conventional ULA Tchebysheff.

Having that as a lower bound, any desired beamwidth curve can then be obtained, where a straight line (invariant beam scanning) is just a special case.

Figure 15:
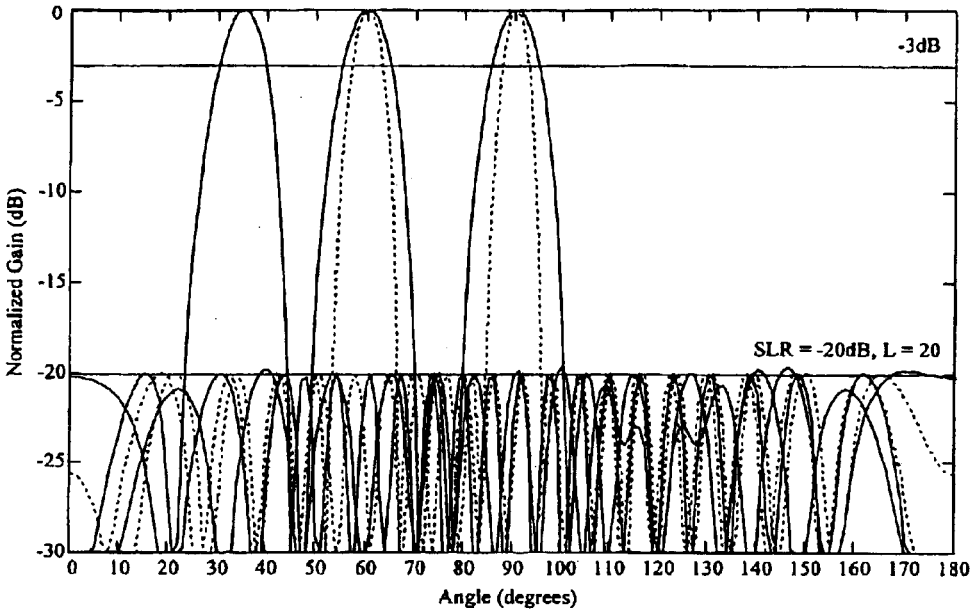
FIG. 15 is a diagram showing steered proposed and classic Dolph-Tchebysheff beampatterns with a ULA with 20 elements.

Next, FIG. 15 exhibits some of the beams in that interval of interest with the purpose to demonstrate how the shape of the mainlobe of the proposed beampattern is approximately preserved while that of the conventional Dolph-Tchebysheff beamformer varies greatly. This will be true whenever the interval of interest is large enough, but still well within the limits determined by equations (9) and (10).

Figure 16:
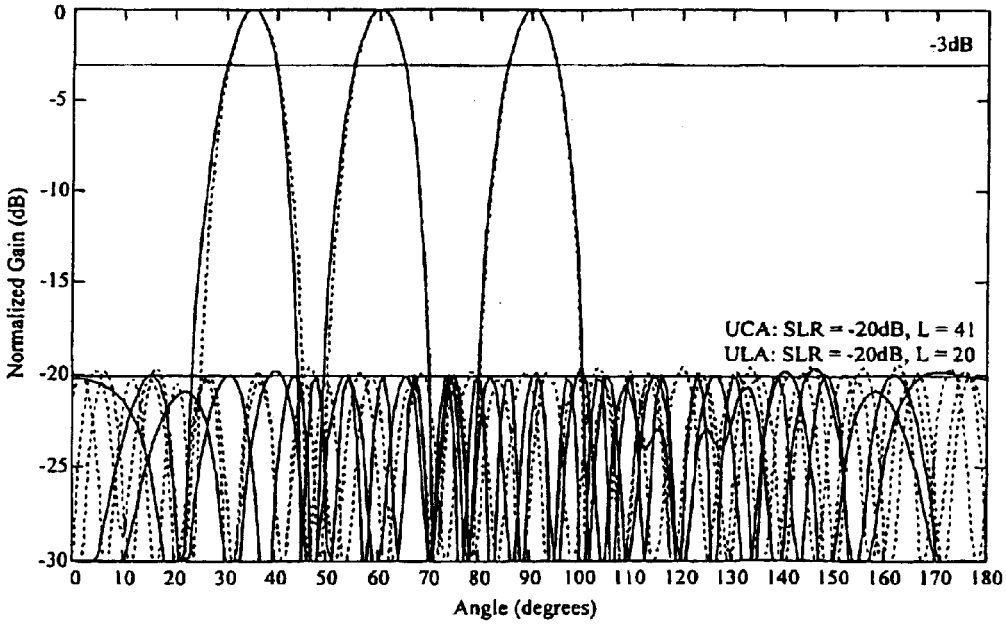
FIG. 16 is a diagram showing steered proposed beampatterns with a ULA with 20 elements and classic Dolph-Tchebysheff beampattern with a UCA with 41 elements.

Finally, FIG. 16 compares the proposed steered beampatterns obtained with a 20-elements ULA to those of a 41-element conventional Dolph-Tchebysheff beampattern obtained with a UCA as proposed in [2], both arrays with half wavelength and set to deliver a sidelobe ratio of −20 dB. It can be seen that with the proposed algorithm a ULA with only 20 elements can deliver the same result as the one yield by a UCA with 41 elements using the conventional Dolph-Tchebysheff design for that particular angle of interval. Of course, for even narrower angles of interest the economy in terms of number of antenna elements is even larger.

Effect of the Invention

According to the present invention, a new technique to design Tchebysheff-like low sidelobe beampatterns that offers the possibility of prescribing both the sidelobe level and the beamwidth has been proposed. The new design method represents an extension of the classic Dolph-Tchebysheff design that has remained almost unchanged since its proposal in 1946, offering enormous possibilities for applications in any communication and radar systems where low sidelobe, beamwidth adjustable mainlobes are desired.

Also, according to the present invention, 2 examples of the applications of the proposed design have been demonstrated. The first consists of a fully adjustable sector-antenna-like beampattern obtained with a UCA, and will find direct applications in Space-Domain Multiple Access (SDMA) systems, Beam Space-Time Coding systems etc. The second consists of a low sidelobe beampattern that is rotation-invariant over a wide range around the broadside, obtained with a ULA containing much less elements than what would be necessary if UCA were used. This design example will find straightforward applications in radar systems in which the angular spatial span to be scanned is limited and over which a uniform precision is desired, such as is case of those required in Intelligent Transport Systems (ITS) systems.

Many other applications to the algorithms hereby proposed may be found if the relationship between array antenna theory and digital filters is considered Although the context in which the developments above explained were array antennas (spatial frequency filtering), the application of the method described is straightforwardly extended to the time frequency domain as well.

What is claimed is:

1. An array antenna comprising:

a plurality of antenna elements, a calculation means for calculating excitation coefficients for each said antenna element in a way such that said antenna elements form a beampattern having a flat top mainlobe of adjustable beamwidth and a predetermined sidelobe level.

2. An array antenna as set forth in claim 1, wherein said antenna elements form a uniform linear array.

3. An array antenna as set forth in claim 1, wherein said antenna elements form a uniform circular array.

* * * * *